US006398065B1

(12) United States Patent
Lewis

(10) Patent No.: US 6,398,065 B1
(45) Date of Patent: Jun. 4, 2002

(54) DECORATIVE MUG

(75) Inventor: Stuart A. Lewis, Syosset, NY (US)

(73) Assignee: High Point Accessories, New York, NY (US)

( * ) Notice: Subject to any disclaimer, the term of this patent is extended or adjusted under 35 U.S.C. 154(b) by 0 days.

(21) Appl. No.: 09/602,137

(22) Filed: Jun. 23, 2000

(51) Int. Cl.[7] ..... B65D 1/40
(52) U.S. Cl. ..... 220/737; 220/592.17; 206/457
(58) Field of Search ..... 206/457, 592.17; 220/630

(56) References Cited

U.S. PATENT DOCUMENTS

| | | | | | |
|---|---|---|---|---|---|
| 2,767,563 | A | * | 10/1956 | Picascia | 220/630 |
| D199,416 | S | | 10/1964 | Katz | |
| 3,507,416 | A | * | 4/1970 | Douglas et al. | 206/457 |
| 3,913,770 | A | * | 10/1975 | Tarro | 206/217 |
| D243,140 | S | | 1/1977 | Frank | |
| D272,793 | S | | 2/1984 | Appel et al. | |
| D306,386 | S | | 3/1990 | Griffin | |
| D308,154 | S | | 5/1990 | Tow | |
| D321,825 | S | | 11/1991 | Schlesselman | |
| D328,005 | S | | 7/1992 | Paullin | |
| D351,530 | S | | 10/1994 | Petrasek | |
| D358,298 | S | | 5/1995 | Brown et al. | |
| D358,299 | S | | 5/1995 | Brown et al. | |
| D358,300 | S | | 5/1995 | Brown et al. | |
| D358,301 | S | | 5/1995 | Brown et al. | |
| 5,531,353 | A | * | 7/1996 | Ward et al. | 220/630 |
| D374,395 | S | | 10/1996 | Petrucci et al. | |
| D374,396 | S | | 10/1996 | Petrucci et al. | |
| D374,617 | S | | 10/1996 | Petrucci et al. | |
| 5,614,275 | A | | 3/1997 | Chan | |
| D380,147 | S | | 6/1997 | Kong | |
| 5,673,789 | A | * | 10/1997 | Degraff-Eugene | 206/217 |
| 5,702,003 | A | | 12/1997 | Springer | |
| 5,769,680 | A | * | 6/1998 | Hoffman | 206/217 |
| D407,605 | S | | 4/1999 | Berger | |
| 6,164,473 | A | * | 12/2000 | Waldrip | 220/630 |

FOREIGN PATENT DOCUMENTS

| | | | | |
|---|---|---|---|---|
| GB | 1180045 | * | 9/1968 | 206/457 |

* cited by examiner

*Primary Examiner*—Joseph M. Moy
(74) *Attorney, Agent, or Firm*—Scully, Scott Murphy & Presser

(57) ABSTRACT

A decorative mug or cup which is designed to be sold and utilized with a decorative character skin or decorative display thereon, and wherein the decorative character skin or decorative display can be readily and easily removed from the mug for placement of the mug in a dishwasher for cleaning or a microwave oven for microwave heating, such that the decorative character skin or decorative display is not ruined, degraded or adversely affected by the washing or microwave heating operation. The character mug comprises a cylindrical mug body with a handle, a removable character skin or decorative display, and a threadedly detachable mug bottom. The threaded engagement of the mug bottom to the cylindrical mug body allows the mug bottom to be easily and conveniently threadedly disengaged from the cylindrical mug body to allow the character skin or decorative display to be easily removed from the cylindrical mug body. The construction also allows the cylindrical mug body and detachable mug bottom to be sold and used with a variety of different decorative character skins or decorative displays.

6 Claims, 3 Drawing Sheets

DECORATIVE MUG

BACKGROUND OF THE INVENTION

1. Field of the Invention

The present invention relates generally to a decorative mug, and more particularly pertains to a decorative mug or cup which is designed to be sold and utilized with a decorative character skin or decorative display thereon. The decorative character skin or decorative display can be removed from the mug for placement of the mug in a dishwasher for cleaning or microwave oven for microwave heating, such that the decorative character skin or decorative display is not ruined, degraded or adversely affected by the washing or microwave heating operation.

2. Discussion of the Prior Art

The prior art discloses a large variety of decorative mugs or cups which are decorated with a myriad of designs such as dinosaurs, animals and other decorative designs.

For instance, Chan U.S. Pat. No. 5,614,275 discloses a high-relief, resiliently flexible, composite molded plastic mug or cup comprising a relatively rigid injection-molded core cup member having a handle and a sleeve-receiving end or section with a pair of opposed inwardly facing, axially spaced apart shoulders. A decorative plastic sleeve member defines a pair of opposed outwardly facing sleeve shoulders. The sleeve member is mounted on the cup member with the sleeve shoulders interengaged with the core cup shoulders to secure the sleeve to the cup.

The composite mug or cup disclosed by Chan is basically designed with a two piece construction to allow the two pieces to be separately molded, with the core cup member being injection molded and the decorative sleeve member being rotationally molded. The two separately molded piece are then assembled together by the manufacturer and sold to a consumer.

The Chan two piece construction is not designed to be disassembled by the consumer, and is not designed for easy release or removal of the decorative plastic sleeve from the central cup, similar to the present invention, to enable just the cup without the decorative plastic sleeve to be placed in a dishwasher or microwave oven.

As described in Chan, the top of a flexible handle is molded to the core cup, and the bottom of the handle includes a latching protrusion, such that the handle can be bent and flexed to engage the latching protrusion with a mating recess in the core cup. Moreover, the decorative sleeve is designed with smaller dimensions than the central cup such that the decorative sleeve must be elastically stretched to be placed upon the central cup.

It is readily apparent from the description in the Chan patent that the decorative sleeve is designed to be stretched and placed around the central cup, and the handle flexed and latched during manufacture of the cup. In fact, the patent only describes a mounting operation, and does not describe a dismounting or removal operation of the decorative sleeve from the cup. Thus, the decorative sleeve and central cup are not designed for easy removal by a consumer of the decorative sleeve from the central cup, similar to the present invention, such that only the central cup can be placed in a dishwasher or microwave oven.

SUMMARY OF THE INVENTION

Accordingly, it is a primary object of the present invention to provide a decorative mug.

A further object of the subject invention is the provision of a decorative mug or cup which is designed to be sold and utilized with a decorative character skin or decorative display thereon. The decorative character skin or decorative display can be readily and easily removed from the mug for placement of the mug in a dishwasher for cleaning or microwave oven for microwave heating, such that the decorative character skin or decorative display is not ruined, degraded or adversely affected by the washing or microwave heating operation.

In accordance with the teachings herein, the present invention provides a decorative mug comprising a substantially cylindrically shaped mug body with a closed bottom and an open top for holding a quantity of liquid therein. A mug handle extends from a top portion of the cylindrical mug body to enable a user to grasp the character mug by the handle.

In a first embodiment, the top portion of the cylindrical mug body also defines a top annular lip extending circumferentially therearound having a diameter which is slightly larger than the diameter of the cylindrical mug body. The bottom portion of the cylindrical mug body defines an exterior threaded portion having threads extending circumferentially therearound. A detachable cap-shaped mug bottom has an internal threaded portion extending circumferentially around the interior thereof, such that the mug bottom can threadedly engage and screw onto the exterior threaded portion of the cylindrical mug body. The mug bottom defines a bottom annular lip extending circumferentially therearound and having a diameter which is slightly larger than the diameter of the cylindrical mug body. A character skin defines a decorative character and has a circular or cylindrical shaped aperture extending therethrough which is substantially the same diameter as the diameter of the cylindrical mug body. The character skin is positioned around the cylindrical mug body and is secured in position relative to the cylindrical mug body between the top annular lip on the cylindrical mug body and the bottom annular lip on the detachable mug bottom.

In a second embodiment, the mug bottom defines a downwardly extending substantially clear decorative display housing which encloses a decorative display therein.

The threaded engagement of the mug bottom to the cylindrical mug body allows the mug bottom to be easily and conveniently threadedly disengaged from the cylindrical mug body to allow the character skin or decorative display to be easily removed from the cylindrical mug body. This allows just the cylindrical mug body to be placed into a dishwasher or microwave oven, without the character skin or decorative display, such that the character skin or decorative display is not adversely affected by a washing operation or a microwave heating operation. It also allows the cylindrical mug body and detachable mug bottom to be sold and used with a variety of different decorative character skins or a variety of decorative displays.

In greater detail, in the first embodiment the character skin can be molded from a resilient material such as a rubber, plastic or flexible metallic type of material and can have decorative character features painted thereon, such that the resilient character skin and painted decorative character features might be adversely affected by a washing operation of a dishwasher or a microwave heating operation of a microwave oven.

In the second embodiment, the clear decorative display housing can enclose decorative figurines, decorative sand, etc. The clear housing can be filled with a gas such as air or an inert gas, or can enclose a suitable liquid, with a shakeable snow flake type of display, or with decorative figurines such as fish, divers, mermaids, underwater craft, etc. suspended therein.

The cylindrical mug body with the top annular lip, the mug handle and the exterior threaded portion can be molded from plastic as one integral molded piece. The detachable mug bottom with the bottom annular lip and the internal threaded portion can also be molded from plastic as one integral molded piece. The character skin can be a high-relief, three dimensional, resiliently flexible, composite molded decorative product.

BRIEF DESCRIPTION OF THE DRAWINGS

The foregoing objects and advantages of the present invention for a decorative mug may be more readily understood by one skilled in the art with reference being had to the following detailed description of several preferred embodiments thereof, taken in conjunction with the accompanying drawings wherein like elements are designated by identical reference numerals throughout the several views, and in which.

DETAILED DESCRIPTION OF THE DRAWINGS

Figure 1:
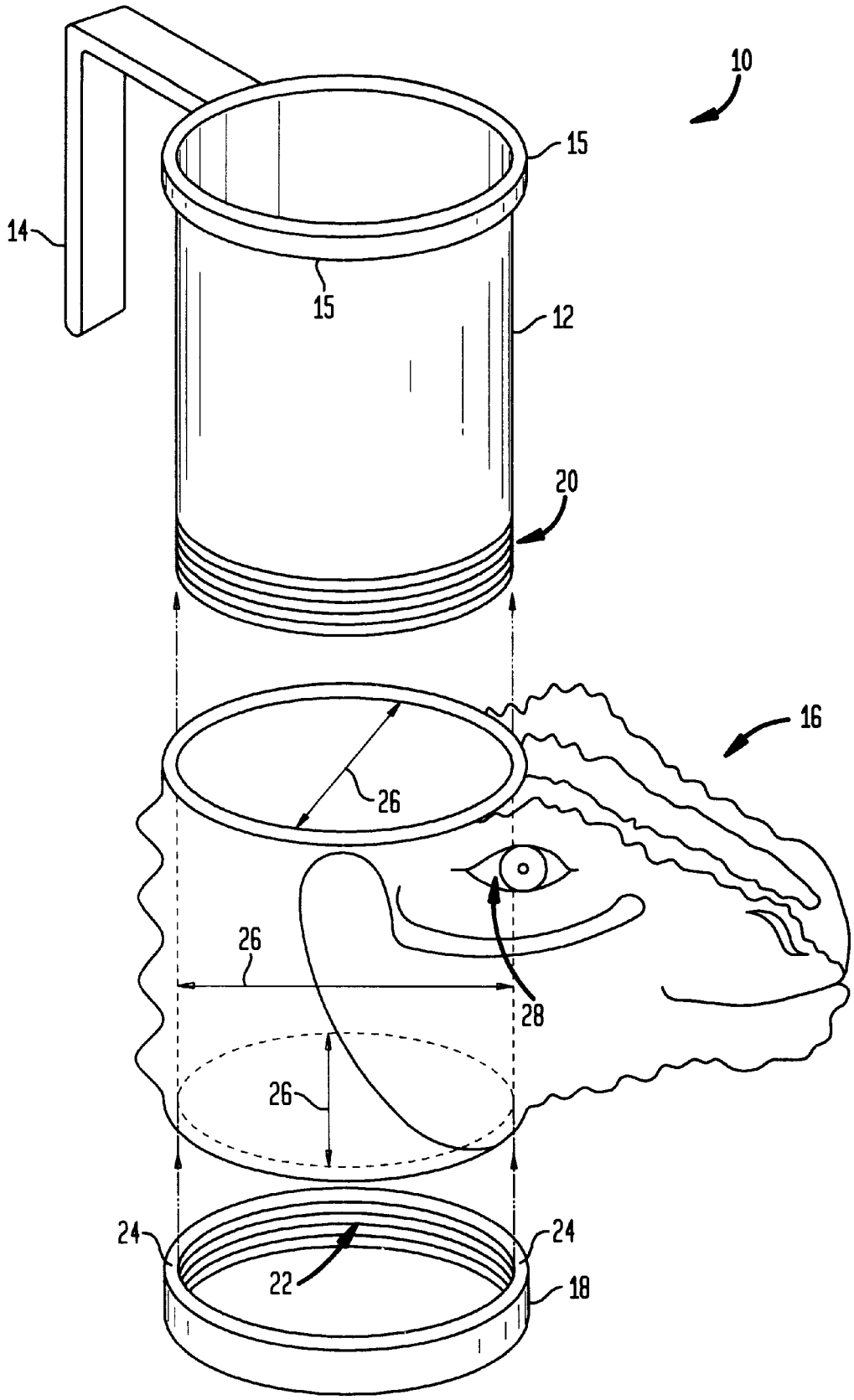
FIG. 1 is a vertically exploded schematic view of a first embodiment of a decorative character mug constructed pursuant to the present invention, and illustrates a cylindrical mug body with a handle, a removable character skin, and a threadedly detachable mug bottom.
Figure 2:
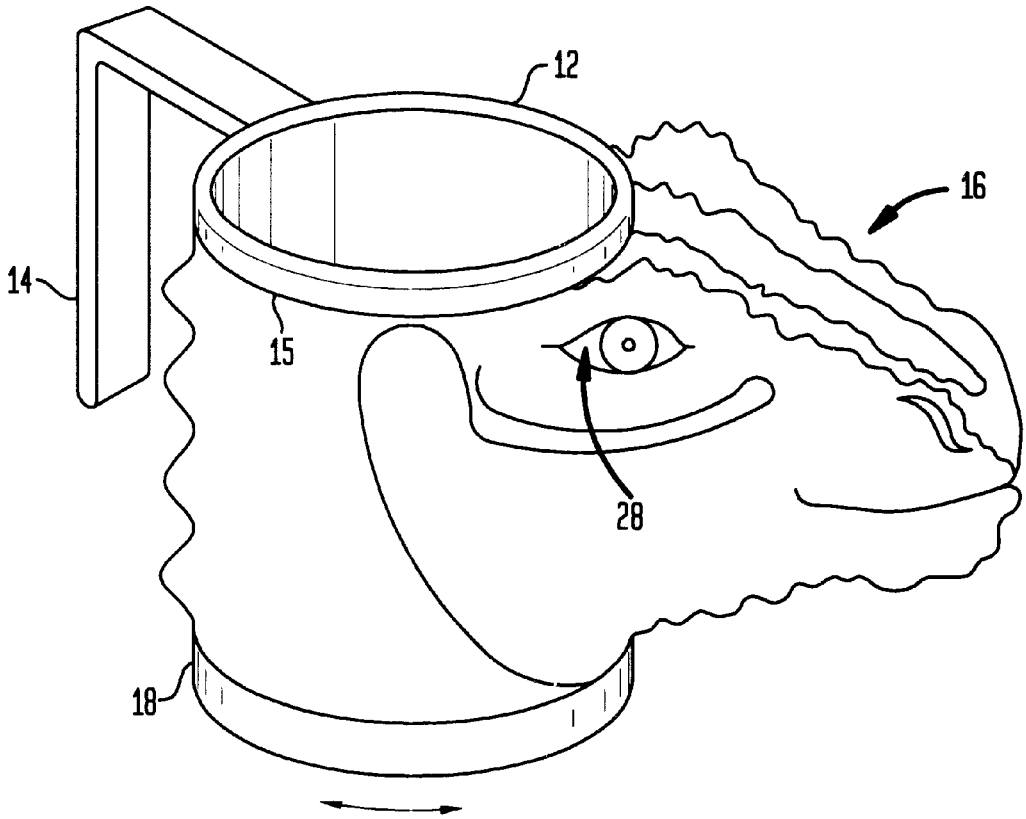
FIG. 2 is fully assembled view of the decorative mug of FIG. 1.

Referring to the drawings in detail, FIG. 1 is a vertically exploded schematic view of a first embodiment of a decorative character mug 10 constructed pursuant to the present invention, and illustrates a cylindrical mug body 12 with a handle 14, a removable character skin 16, and a threadedly detachable mug bottom 18. FIG. 2 is fully assembled view of the character mug of FIG. 1.

The decorative mug 10 comprises a substantially cylindrically shaped mug body 12 with a closed bottom and an open top for holding a quantity of liquid therein. A mug handle 14 extends from a top portion of the cylindrical mug body to enable a user to grasp the mug by the handle. In the first embodiment, the top portion of the cylindrical mug body also defines a top annular lip 15 extending circumferentially therearound having a diameter which is larger than the diameter of the cylindrical mug body 12. The bottom portion of the cylindrical mug body 12 defines an exterior threaded portion 20 having threads extending circumferentially therearound.

The detachable cap-shaped mug bottom 18 has an internal threaded portion 22 extending circumferentially around the interior thereof, such that the mug bottom 18 can threadedly engage and screw onto the exterior threaded portion 20 of the cylindrical mug body 12. In the first embodiment, the mug bottom defines a bottom annular lip 24 extending circumferentially threrearound and having a diameter which is slightly larger than the diameter of the cylindrical mug body 12.

The removable character skin 16 defines a decorative character and has a circular or cylindrical shaped aperture 26 extending therethrough which is substantially the same diameter as the diameter of the cylindrical mug body 12. The character skin 16 is positioned around the cylindrical mug body and is secured in place relative to the cylindrical mug body between the top annular lip 15 on the cylindrical mug body 12 and the bottom annular lip 24 on the detachable mug bottom 18.

Figure 3:
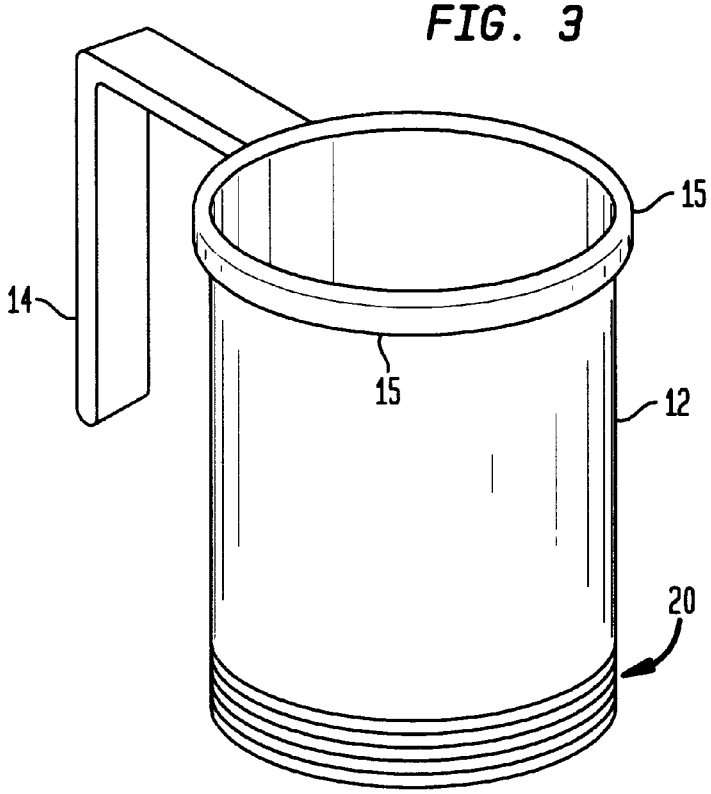
FIG. 3 illustrates just the cylindrical mug body with a handle, with the character skin and mug bottom removed therefrom, as the mug body is suitable to be placed in a dishwasher for a washing operation or a microwave oven for microwave heating.

The threaded engagement of the mug bottom 18 to the cylindrical mug body 12 allows the mug bottom to be easily and conveniently threadedly disengaged from the cylindrical mug body 12 to allow the character skin 16 to be easily removed from the cylindrical mug body 12. This allows just the cylindrical mug body 12, as illustrated in FIG. 3, to be placed into a dishwasher or microwave oven without the character skin 16, such that the character skin is not adversely affected by a washing operation or a microwave heating operation. It also allows the cylindrical mug body 12 and detachable mug bottom 18 to be sold and used with a variety of different decorative character skins 16.

FIG. 3 illustrates just the cylindrical mug body 12 with the handle 14, with the character skin 16 and mug bottom 18 removed therefrom, as the mug body 12 is suitable to be placed in a dishwasher for a washing operation or a microwave oven for microwave heating.

FIGS. 1 and 2 illustrate a character skin in the shape of a dinosaur, but the character skin could be any type of scene, animal or character, either real or cartoon in appearance.

The character skin 16 is preferably molded from a resilient material such as a rubber, plastic or resilient metal type of material, and can have decorative character features, such as the eyes 28, painted thereon, such that the resilient character skin and painted decorative character features might be adversely affected by a washing operation of a dishwasher or a microwave heating operation of a microwave oven.

The cylindrical mug body 12 with the top annular lip, the mug handle 14, and the annular lip 15 and the exterior threaded portion 20 can be injection molded from plastic as one integral molded piece.

The detachable mug bottom 18 with the bottom annular lip 24 and the internal threaded portion 22 can also be injection molded from plastic as one integral molded piece.

The character skin 16 can be a high-relief, three dimensional, resiliently flexible, composite molded decorative product which can be molded using any appropriate molding technology.

Figure 4:
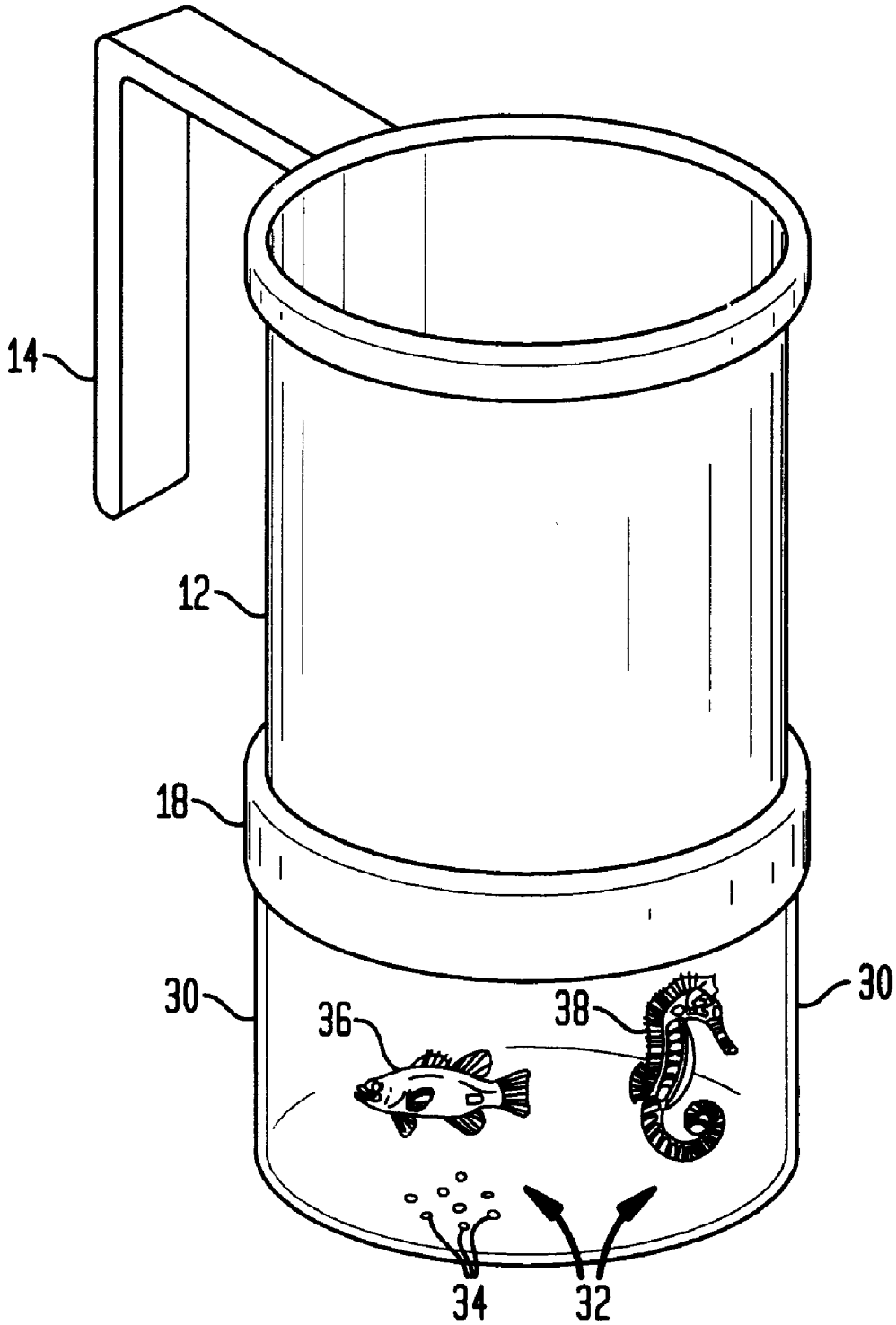
FIG. 4 illustrates a second embodiment of a decorative mug wherein the mug bottom defines a downwardly extending substantially clear decorative display housing which encloses a decorative display therein.

FIG. 4 illustrates a second embodiment of a decorative mug wherein the mug bottom 18 defines a downwardly extending substantially clear plastic display housing 30 which encloses a decorative display 32 therein such as decorative figurines, decorative sand, etc. The clear housing can be filled with a gas such as air or an inert gas, or can enclose a suitable liquid, with a shakeable snow flake 34 type of display, or with decorative moveable figurines such as fish 36 sea horses 38, divers, sea mermaids underwater craft, etc., suspended therein.

The threaded engagement of the mug bottom 18 to the cylindrical mug body 12 allows the mug bottom with the display housing 30 to be easily and conveniently threadedly disengaged from the cylindrical mug body 12. This allows just the cylindrical mug body 12, as illustrated in FIG. 3, to be placed into a dishwasher or microwave oven without the decorative housing 30, such that the decorative housing and display therein are not adversely affected by a washing operation or a microwave heating operation. It also allows the cylindrical mug body 12 and detachable mug bottom 18 to be sold and used with a variety of different decorative displays.

The second embodiment does not really require the top and bottom annular lips of the first embodiment, and may or may not include those features.

While several embodiments and variations of the present invention for a decorative mug are described in detail herein, it should be apparent that the disclosure and teachings of the present invention will suggest many alternative designs to those skilled in the art.

What is claimed is:

1. A decorative mug comprising:

a. a mug comprising a substantially cylindrically shaped mug body with a closed bottom and an open top for holding a quantity of liquid therein;

b. a mug handle extending from a top portion of the cylindrical mug body to enable a user to grasp the character mug by the handle;

c. a bottom portion of the cylindrical mug body defining an exterior threaded portion having threads extending circumferentially around the exterior bottom portion of the cylindrical mug body;

d. a detachable cap-shaped mug bottom having an internal threaded portion extending circumferentially around the interior of the cap-shaped mug bottom, wherein the mug bottom threadedly engages and screws onto the exterior threaded portion of the cylindrical mug body, and wherein the mug bottom defines a bottom annular lip extending circumferentially threrearound and having a diameter which is larger than the diameter of the cylindrical mug body;

e. a character skin defining a decorative character and having a circular shaped aperture extending therethrough which is substantially the same diameter as the diameter of the cylindrical mug body, with the character skin being positioned around the cylindrical mug body and being secured in place relative to the cylindrical mug body by the bottom annular lip of the mug bottom, wherein the threaded engagement of the mug bottom to the cylindrical mug body allows the mug bottom to be threadedly disengaged from the cylindrical mug body to allow the character skin to be removed from the cylindrical mug body, to allow just the cylindrical mug body to be placed into a dishwasher or microwave oven without the character skin such that the character skin is not adversely affected by a washing operation or a microwave heating operation, and also allows the cylindrical mug body and detachable mug bottom to be sold and used with a variety of different decorative character skins.

2. The decorative mug of claim 1, wherein the character skin is molded from a resilient type of material and has decorative character features painted thereon, such that the resilient character skin and painted decorative character features might be adversely affected by a washing operation of a dishwasher or a microwave heating operation of a microwave oven.

3. The decorative mug of claim 1, wherein the top portion of the cylindrical mug body defines a top annular lip extending circumferentially therearound having a diameter which is larger than the diameter of the cylindrical mug body, and the character skin is secured in position between the top annular lip on the cylindrical mug body and the bottom annular lip on the detachable mug bottom.

4. The decorative mug of claim 1, wherein the cylindrical mug body with the top annular lip, the mug handle and the exterior threaded portion are molded from plastic as one integral molded piece.

5. The decorative mug of claim 1, wherein the detachable mug bottom with the bottom annular lip and the internal threaded portion are molded from plastic as one integral molded piece.

6. The decorative mug of claim 1, wherein the character skin is a high-relief, three dimensional, resiliently flexible, composite molded decorative product.

* * * * *